United States Patent [19]

Clish

[11] Patent Number: 4,711,277

[45] Date of Patent: Dec. 8, 1987

[54] FILLER NOZZLE WITH CAPILLARY ACTION AND ITS METHOD OF OPERATION

[75] Inventor: Robert J. Clish, Mobile, Ala.

[73] Assignee: International Paper Company, Purchase, N.Y.

[21] Appl. No.: 401,254

[22] Filed: Jul. 23, 1982

[51] Int. Cl.[4] ..... B65B 3/04; B67C 3/22

[52] U.S. Cl. ..... 141/311 A; 141/1; 141/31; 141/115; 141/128; 141/392; 239/558; 239/567; 222/566; 222/575; 222/571

[58] Field of Search ..... 239/558, 559, 567, 562, 239/570; 141/1, 2, 31, 70, 103, 115, 128, 181, 182, 250, 251, 263, 270, 275, 285, 286, 291, 301, 302, 311, 312, 318, 367, 392; 222/565, 478, 479, 566, 571, 575

[56] References Cited

U.S. PATENT DOCUMENTS

| | | | |
|---|---|---|---|
| 2,030,951 | 2/1936 | Winton | 141/86 |
| 2,055,923 | 9/1936 | Buttner et al. | 141/1 |
| 2,328,372 | 8/1943 | Wollenweber | 141/103 |
| 2,382,151 | 8/1945 | Harper, Jr. | 239/558 |
| 2,724,535 | 11/1955 | Day et al. | 141/275 |
| 2,752,083 | 6/1956 | Ullman et al. | 141/70 X |
| 3,207,188 | 9/1965 | Brown | 141/286 |
| 3,209,794 | 10/1965 | Granier | 141/70 |
| 4,139,158 | 2/1979 | Uchida | 239/559 |

FOREIGN PATENT DOCUMENTS

| | | | |
|---|---|---|---|
| 712230 | 7/1954 | United Kingdom . | |
| 2019813 | 11/1979 | United Kingdom | 141/70 |

*Primary Examiner*—Henry J. Recla
*Assistant Examiner*—Ernest G. Cusick
*Attorney, Agent, or Firm*—Walt Thomas Zielinski

[57] ABSTRACT

A method for the filling of a container with a potable liquid, such as fruit juice, and a filler nozzle for practicing the method. Prior methods for filling containers with potable liquids have often employed a series of nozzles, each discharging a single stream of liquid, falling under the action of gravity, vertically downward through an opening in a nozzle, each nozzle acting in cooperation and being attached to its valve. As the container is filled, both splashing and foaming of the liquid in the container, has often caused problems. According to the method and apparatus of this invention, the potable liquid to be dispensed into a container is directed to the interior surface of the container at a point above its intended fill level. By virtue of this method, foaming and splashing are minimized at each filler nozzle station. Further in accordance with the method and nozzle of this invention, a plurality of annularly spaced passageways are provided in the head of the dispensing nozzle, wherein the ratio of the length to the diameter of each of the passageways is not less than a certain minimum value. With this minimum value, found for many liquids to be four, when the valve to which the nozzle is attached is shut off, capillary attraction of the liquid remaining in the nozzle and within the passageways thereof inhibits further flow of the liquid downwardly into the container, thereby inhibiting problems caused by dripping and drooling.

9 Claims, 4 Drawing Figures

FILLER NOZZLE WITH CAPILLARY ACTION AND ITS METHOD OF OPERATION

This invention relates to a novel method and apparatus for the filling of containers with potable liquids, such as the filling of paperboard cartons with fruit juices such as grapefruit juice, orange juice, prune juice, apple juice, and the like.

In a typical prior art method and apparatus, a plurality of open ended containers, closed at their bottoms, are sequentially and continuously placed and removed from a moving line, such as an endless belt or a rotary turrent carrier. In turn, each one of the open containers is positioned directly beneath a dispensing spout or nozzle. The nozzle includes a head attached to a valve body, the valve body including the usual valve seat which is movable to open and close the valve, to thereby permit and to stop the flow of potable liquid through the valve, through the nozzle and thence down into the container. Usually, the nozzle head is provided with an opening or passageway containing a wire mesh screen for controlling flow and aeration of the liquid stream being discharged. When the filling process for each controller commences, the valve is opened and the potable liquid passes down into the container. Often a single container is progressively filled by a plurality of nozzle stations spaced along a conveyor line. With continued flow at each station, the level of liquid within the container rises until such time as the intended fill level of the container for each station is reached. At each station, the valve is closed by closing the valve seat, the flow of the potable liquid through the valve and nozzle substantially stops, the container is now moved to another position or another station for further filling and, finally, for closure of the container and other operations on the container prior to its shipment.

This method and apparatus has been found to exhibit several drawbacks. For example, when the liquid from each dispensing nozzle falls vertically down into the container, there is splashing present. Said splashing may be so severe as to result in droplets splashing onto internal top seal areas resulting in a poor top seal and up above the open end of the container and onto the exterior surface thereof, as well as onto adjacent portions of the filling and packaging machinery. This not only results in less desirable and unacceptable top seals due to splashing but there is waste of the potable liquid and the splashing causes problems of messiness on both the container, and on the machinery used for filling. Another disadvantage of prior methods and apparatus is that of foaming. When a single stream of liquid falls vertically downwardly onto and into the liquid in the container being filled, there often arises a foam. This foam at times is difficult to control and is also difficult if not impossible to predict, as respect to its height and duration. This foam level height is often high enough to come in contact with the mentioned top seal areas of the carton, also resulting in less desirable and unacceptable top seals.

Yet another disadvantage of prior art methods and apparatus is due to dripping and drooling of the nozzle when the valve is cut-off. While the valve seat, even if perfect, will stop flow through the main portion of the valve body, there will always remain some liquid in the portion of the nozzle head below the valve seat and above the lower tip of the nozzle upon valve cut-off. Thus, when a filled or partially filled container is moved from its position directly beneath one filling nozzle to another filling nozzle, dripping and drooling of the dispensing nozzles will cause many of the same problems above discussed, i.e., dripping onto a container, or dripping onto an empty container which is to be filled, or dripping onto the machinery or some combination of all of these. Such dripping and drooling can induce volumetric variations substantial enough to result in an unacceptable filled carton.

According to the practice of the present invention, many of these problems encountered in the prior art are substantially minimized and for practical purposes overcome. According to the practice of this invention, problems due to splashing and problems due to foaming and volumetric variation of the liquid are overcome by directing a plurality of jets of the potable liquid against the interior surface of the container at each filling station. The point at which the streams or jets of liquid strike the interiors of the containers is at a point somewhat above the intended fill level for each station and well below top seal areas of the container. By virtue of this method, the liquid never strikes liquid already in the container, it always strikes the side wall of the container, thereby minimizing problems due to splashing and foaming. Further, according to the practice of this invention, problems due to dripping of the nozzle upon valve cut-off are substantially minimized and for practical purposes eliminated. This is accomplished in the following manner. Depending upon the properties of the particular liquid being dispensed, such as its temperature, pulp concentration, pulp consistency, length of pulp fibers, surface tension, viscosity, and wetability the ratio of the length to the diameter of the fluid passageway in the nozzle head is made such that upon valve cut-off, the capillary attraction of the liquid in the passageways is so strong that no liquid will pass down through the passageways. The phenomenon of capillary attraction is well known. For example, if a common drinking straw is placed into a glass of water and then the upper end of the straw is closed by the tip of a finger, and the straw is withdrawn, it will be found that no liquid will fall out of the bottom end of the straw. Thus, capillary attraction keeps the liquid in the bottom of the straw. It is this action which I have taken advantage of to produce one of the desirable end results of this invention.

Figure 1:
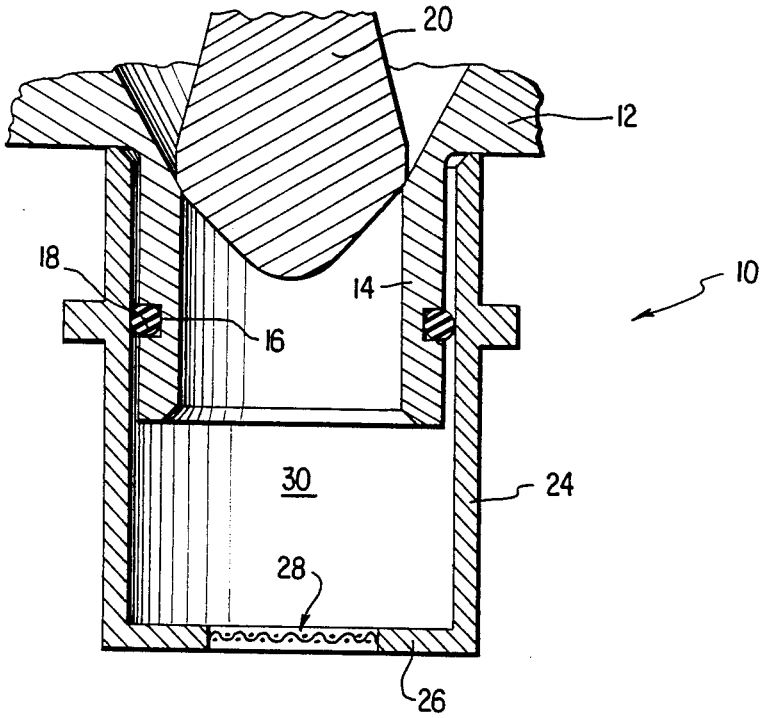
FIG. 1 (PRIOR ART)
FIG. 1 is a partial cross-sectional view of a typical prior art valve and nozzle construction for a dispensing nozzle for potable liquids such as fruit juices.

Referring now to FIG. 1 of the drawings, a typical prior art valve and filler nozzle construction for a potable liquid is illustrated.

The numeral 10 denotes generally the nozzle and valve construction, the valve including a body portion denoted by the numeral 12, this body portion having a downwardly extending tubular portion or spout 14 whose exterior surface is provided with a continuous annular groove 16, the groove carrying a conventional O-ring seal 18 for sealing and securing the filler nozzle to the valve body. The numeral 24 denotes the nozzle defined by a generally tubular wall portion whose inside surface is contacted by the seal member 18, and whose lower surface is closed by portion 26 having an aperture therein, the aperture carrying a conventional wire mesh screen 28. While only one such screen 28 is shown, in practice several may be employed, stacked and spaced one on top of each other. The numeral 30 denotes generally the interior volume of the nozzle which is beneath the valve stem 20 and within portions 14, 24.

The reader will now be in a position to readily comprehend that when valve member 20 is closed, as it is in the position shown, even though liquid will not pass through the spout element 14 of the valve, there will nonetheless be liquid remaining in volume 30 and this liquid will usually result in dripping and drooling. It will further be apparent from a consideration of FIG. 1 that liquid passing through the wire mesh screen 28 will cause or will leave a residual of pulp, termed a fibrage, in the interstices of the screen. Eventually, the screen 28 can become clogged, or partially clogged, thus necessitating shut down of the filling process. Further, the build-up of pulp may not be uniform, depending on the particular potable liquid being dispensed, and therefore non-uniform and time consuming replacement of screen 28 may result. It will further be apparent that the problems earlier discussed due to the liquid falling through screen 28 and into the container being filled will cause splashing and foaming.

Figure 3:
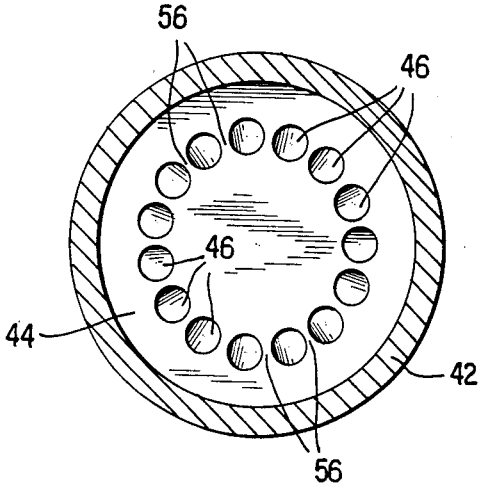
FIG. 3 is a view taken along section 3—3 of FIG. 2.
Figure 4:
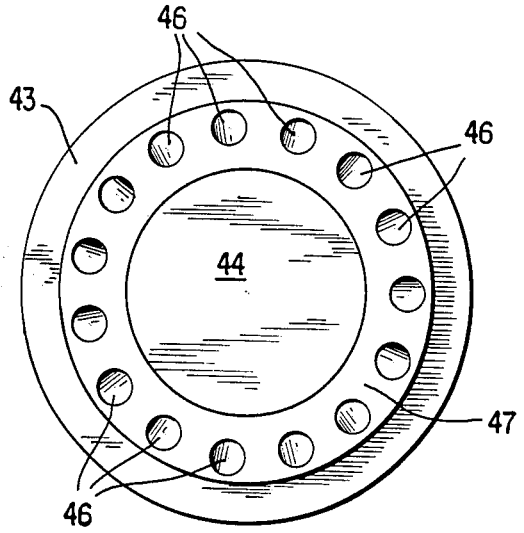
FIG. 4 is a view taken along section 4—4 of FIG. 2.
Figure 2:
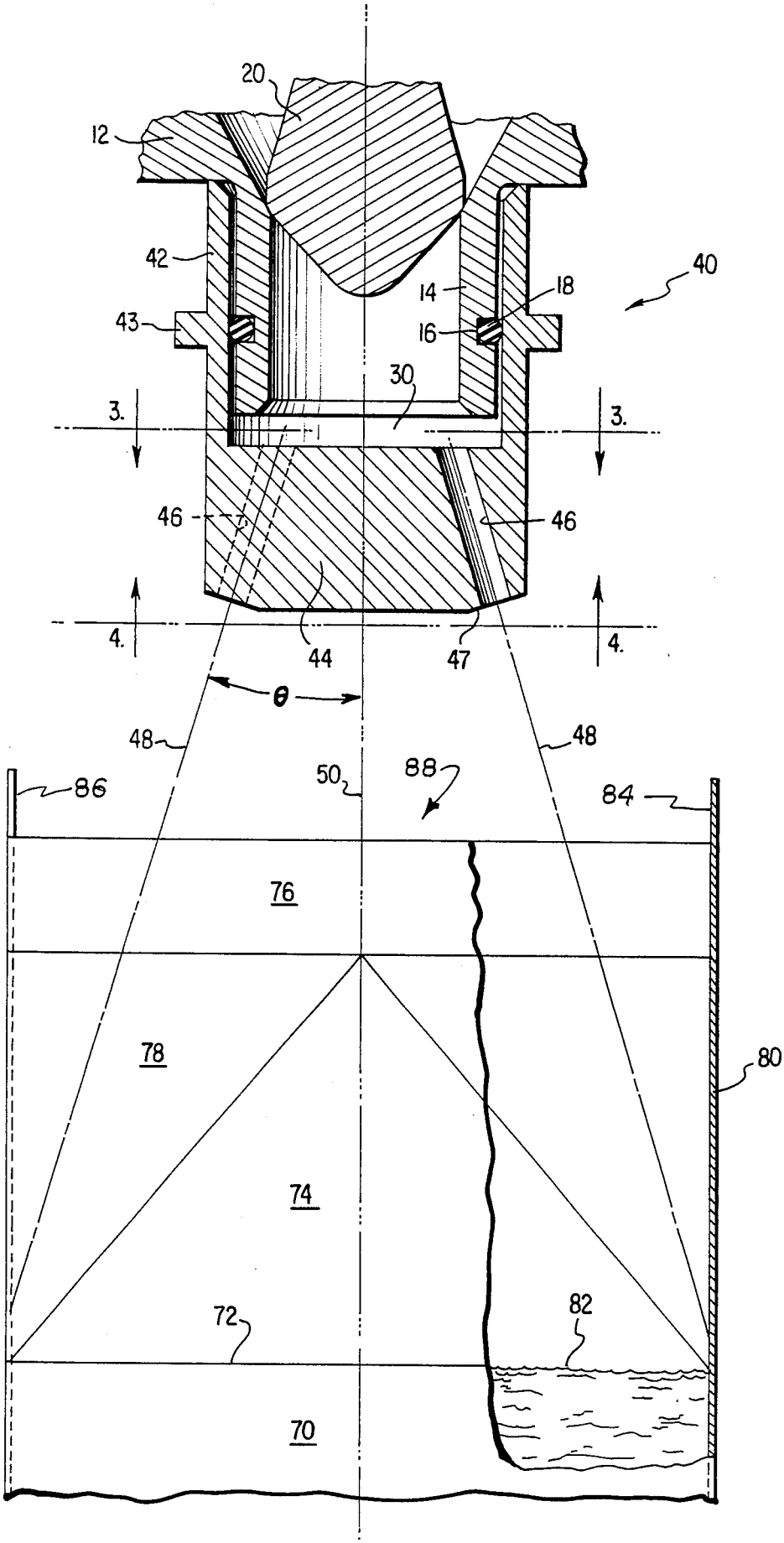
FIG. 2 is a view similar to FIG. 1, showing both the novel filling nozzle of this invention and its relation to a typical container used for the reception of potable liquids such as the usual paperboard carton.

Referring now to FIGS. 2–4 of the drawings, the novel method and apparatus of this invention will be disclosed. Referring now to FIG. 2 of the drawings, the numeral 40 denotes generally the novel filler nozzle of this invention and includes an upstanding and circular extension 42 integral with orifice head 44 which orifice head has upper and lower surfaces. A finger grip 43 for nozzle removal may be employed, the remaining portions of the valve bearing the same numerals as appear in FIG. 1 and which have been described in connection therewith. As may be seen from the upper portion of FIG. 2, and from FIGS. 3 and 4, the orifice head has no wire mesh screens, such as screen 28 shown in FIG. 1, and is provided with a plurality of annularly or circumferentially disposed passageways 46. The exit end of each passageway has a longitudinal axis denoted by the numeral 48. An imaginary longitudinal axis 50 is shown for the nozzle 40. The reader will observe that there is an angle between axes 48 and 50, this being, in one embodiment of the invention, approximately 16°. As shown at FIG. 3, there is a spacing 56 between the upper ends of passageways 46. This spacing 56 defines a land portion between any adjacent two passageways 46. In one embodiment of the invention, a minimum valve of the distance 56 between adjacent apertures 46 is found to be 1/32 of an inch for many of the potable liquids such as grapefruit juice. By virtue of this minimum dimension of land portion 56, build-up of juice pulp fibers between the entrance or upper portions of adjacent passageways 46 is substantially inhibited. Lesser values of this dimension have been found not to yield satisfactory results, with pulp fiber build-up being present. In the specific embodiment illustrated at FIGS. 3 and 4, the angular displacement or circumferential displacement between passageways 46 is shown as 24°. Annular bevel surface 47 is perpendicular to the exit ends of passageways 46. However, as is clear from FIGS. 2 and 3, the uppermost part or entrance to each passageway 46 lies in the same plane as the upper surface of orifice head 44, and such plane is perpendicular to the imaginary longitudinal axis 50.

Further, according to the practice of this invention, problems due to dripping of the nozzle upon valve cut-off are substantially minimized and for practical purposes eliminated. This is accomplished in the following manner. Depending upon the properties of the particular liquid being dispensed, such as its temperature, pulp concentration, pulp consistency, length of pulp fibers, surface tension, viscosity, and wetability, the ratio of the length to the diameter of the fluid passageways in the nozzle head is made such that upon valve cut-off, the capillary attraction of the liquid in the passageways is so strong that no liquid will pass down through the passageways. The minimum value of the ratio of the length of each passageway to its width has a value of four. The phenomenon of capillary attraction is well known. For example, if a common drinking straw is placed into a glass of water and then the upper end of the straw is closed by the tip of a finger, and the straw is withdrawn, it will be found that no liquid will fall out of the bottom end of the straw. Thus, capillary attraction, which keeps the liquid in the bottom of the straw, is the action that has been taken advantage of to produce one of the desirable end results of this invention.

Again referring to FIG. 2 of the drawings, particularly the lower portion thereof, the numeral 70 denotes the upper portion of a typical container or carton which is to be filled with a potable liquid, such as a fruit juice.

Carton 70 has a closed bottom and is positioned on, for example, an endless belt. The reader will understand that after carton 70 has passed under several nozzles at a plurality of filling stations, it finally reaches the stage shown at FIG. 2, namely, it is very nearly filled to its intended fill level. After final filling, it is moved away from beneath the last filling nozzle 40 for sealing and for any other treatment.

Carton 70 may be of the conventional gabletop construction, formed of paperboard, and includes score line 72, panel portions 74, 76, and 78. The side walls of container 70 are denoted by the numeral 80, while the intended maximum fill level of the container is denoted by the numeral 82. The reader will understand that fill level 82 may be above score line 72, at score line 72, or below score line 72. The numerals 84, 86 and 88 denote top seal areas of the upper flaps of carton 70.

As shown by a consideration of the axis 48 of each of the passageways 46, the individual jets or streams of the liquids from passageways 46 of nozzle 40 strike the interior surface of side walls 80 at a point above the intended fill level 82. In this manner, streams of liquid always strike the interior walls 80 of the container and never strike the liquid in the container, thereby inhibiting splashing as well as foaming, all as previously described.

The reader will understand that FIG. 2 depicts the last filling stage or station. In other, upstream, filling stations, the point at which axes 48 (the liquid stream axes) meet walls 80 is always above the intended fill level at each filler station. Thus, where a plurality of angularly spaced streams is employed, the plurality of streams, taken together, are in the general shape of a pyramid whose apex is above the container being filled and whose base is at a vertical level corresponding to the intersection of the streams with the inner walls of the container at each filler nozzle station. Accordingly, the angle theta ($\theta$) between axis 50 and axes 48 may vary, depending upon the intended or desired intersect point on side walls 80 with axes 48, above the intended liquid level for each filler station, but in all cases, angle theta is less than 90°.

In one typical embodiment, the head of liquid above the orifice head 44 was about 18½ inches and was not pressurized. The particular potable liquid employed was grapefruit juice, the ratio of the length of the passageways 46 to their diameters was approximately five (as shown at FIG. 2), the angle between axes 48 and imaginery axis 50 was about 16°. The diameter of the centers of passageways 46, at the upper portion of the orifice head 44 (see FIG. 3) was about 0.746 inches, with land portion 56 being about 1/32 of an inch. The diameter of passageways 46 was about ⅛ inch. The thickness of orifice head 44 was approximately ⅝ of an inch. The size of the container 70, being of the usual paper-board and gable-top type was one quart. For a one-half gallon paperboard container, the angle between passageway axes 48 and axis 50 was about 21°.

The invention above described has been found to exhibit particular utility in the filling of containers with hot fruit juices, such as grapefruit juice, as is the case with aseptic packaging.

What is claimed is:

1. A filling nozzle particularly adapted to fill containers with potable liquids containing pulp fibers therein, such as fruit juices, the containers having top seal areas and a maximum intended fill level, which is below the top seal area, the nozzle being adapted for mounting on a valve, the valve having a valve seat for closing the valve when it is desired to stop flow through the nozzle, the nozzle including an orifice head having upper and lower surfaces, wherein the orifice head has an imaginary longitudinal axis, the orifice head having a plurality of spaced-apart fluid passageways extending completely through the orifice head, each said passageway being angled such that the stream of liquid flowing therethrough strikes the container at an inside wall portion thereof at a point above said maximum intended fill level of the container, each such passageway having an uppermost part and an exit end, the uppermost part of each said passageway lying in the same plane as the upper surface of said orifice head, said plane being perpendicular to the imaginary longitudinal axis of said orifice head and wherein the spacing between the uppermost portions of said angularly disposed passageways is at least about 1/32 of an inch, whereby a land portion of about 1/32 of an inch is defined between the uppermost portions of said passageways to thereby inhibit the build-up of pulp fibers which may be in said potable liquid flowing through the nozzle, and wherein the angle between the longitudinal axes of the exit end of the passageways and said imaginary longitudinal axis of the nozzle is less than 90°, the ratio of the length of the passageways to their diameter or width having a mimimum value of four, and being such that when the valve is shut off to stop the flow of liquid through the valve and through the nozzle, capillary attraction of the liquid within the passageways is great enough to prevent further flow through the passageways, whereby closing the valve will not only stop fluid flow through the valve, but will also prevent dripping and drooling of the liquid through the passageways of the orifice head, until such time as the valve is again opened and fluid flow through the passageways recommences.

2. The nozzle of claim 1 wherein the angle between the longitudinal axis of the exit end of each of said passageways and said imaginary longitudinal axis of the nozzle is about 16°.

3. The nozzle of claim 1 wherein the angle between the longitudinal axis of the exit end of each of said passageways and said imaginary longitudinal axis of the nozzle is about 21½°.

4. The nozzle of claim 1 including an annular upstanding wall, integral with a peripheral portion of the orifice head, the peripheral wall having a smooth interior surface, one portion of said smooth interior surface adapted to come into contact with a seal member carried by the valve.

5. A method of filling containers with potable liquids containing pulp fibers therein, such as fruit juices, the containers having top seal areas and a maximum intended fill level, which is below the top seal area, which includes the step of directing at least one stream of liquid through a filling nozzle vertically disposed above the container, the nozzle being adapted for mounting on a valve, the valve having a valve seat for closing the valve when it is desired to stop flow through the nozzle, the nozzle including an orifice head, wherein the orifice head has an imaginary longitudinal axis and upper and lower surfaces, the orifice head having a plurality of spaced-apart fluid passageways, extending completely through the orifice head, said passageways being angled such that the stream of liquid flowing therethrough strikes the container at an inside wall portion thereof at a point above said maximum fill level of the container, each such passageway having an uppermost part and an exit end, the uppermost part of each said passageway lying in the same plane as the upper surface of said orifice head, said plane being perpendicular to the imaginary longitudinal axis of said orifice head and wherein the spacing between the uppermost portions of said passageways is at least about 1/32 of an inch, whereby a land portion of about 1/32 of an inch is defined between the uppermost portions of said passageways to thereby inhibit the build-up of pulp fibers which may be in said liquid, flowing through the nozzle, wherein the orifice head has an imaginary longitudinal axis, and wherein the angle between the longitudinal axes of the exit end of the passageways and said imaginary longitudinal axis of the nozzle is less than 90°, the ratio of the length of the passageways to their diameter or width having a minimum value of four, whereby foaming and/or splashing of said liquid being dispensed from the nozzle into the container is minimized.

6. The method of claim 5 wherein a plurality of annularly spaced streams is employed, whereby the plurality of streams, taken together, are in the general shape of a pyramid whose apex is above the container being filled and whose base is at a vertical level corresponding to the intersection of the streams with the inner walls of the container.

7. The method of claim 5 wherein the container is a container formed of paperboard or the like and is generally square in transverse cross-section.

8. The method of claim 5 wherein the nozzle is disposed on the longitudinal, vertical axis of the container.

9. The method of claim 5 in which a container is filled at a series of filler nozzle stations, the liquid in the container increasing at each station.

* * * * *